US009366499B2

(12) United States Patent
Maeda

(10) Patent No.: US 9,366,499 B2
(45) Date of Patent: Jun. 14, 2016

(54) TOY GUN

(71) Applicant: Maruzen Company Limited, Tokyo (JP)

(72) Inventor: Tetsuo Maeda, Tokyo (JP)

(73) Assignee: MARUZEN COMPANY LIMITED, Tokyo (JP)

( * ) Notice: Subject to any disclaimer, the term of this patent is extended or adjusted under 35 U.S.C. 154(b) by 8 days.

(21) Appl. No.: 14/338,890

(22) Filed: Jul. 23, 2014

(65) Prior Publication Data

US 2015/0027427 A1 Jan. 29, 2015

(30) Foreign Application Priority Data

Jul. 23, 2013 (JP) ..... 2013-152915

(51) Int. Cl.

| | |
|---|---|
| ***F41B 11/55*** | (2013.01) |
| ***F41B 11/52*** | (2013.01) |
| ***F41B 11/51*** | (2013.01) |
| ***F41B 11/60*** | (2013.01) |

(52) U.S. Cl.

CPC ..... *F41B 11/52* (2013.01); *F41B 11/51* (2013.01); *F41B 11/55* (2013.01); *F41B 11/60* (2013.01)

(58) Field of Classification Search

CPC ..... F41A 9/61; F41A 9/64; F41A 9/72
USPC ..... 42/49.01, 49.02, 50, 6; 124/45, 51.1, 52
See application file for complete search history.

(56) References Cited

U.S. PATENT DOCUMENTS 1,369,401 A * 2/1921 Cox ..... F41B 7/006 124/27
1,886,704 A * 11/1932 Loomis ..... F41A 9/72 124/52

(Continued)

FOREIGN PATENT DOCUMENTS

| | | | |
|---|---|---|---|
| FR | 428.739 | A | 9/1911 |
| JP | 2013-044460 | A | 3/2013 |

OTHER PUBLICATIONS

European Search Report issued in Application No. 14002423.3-1655, mailed Sep. 17, 2014.

*Primary Examiner* — Jonathan C Weber
(74) *Attorney, Agent, or Firm* — Michael Best & Friedrich LLP

(57) ABSTRACT

A toy gun includes a barrel in which bullets travel due to released gas, a magazine that is cylindrically shaped and disposed in parallel with the barrel to house the bullets, a magazine joint that couples the rear end of the magazine to the barrel and allows the bullets to travel therein, a cut portion disposed between the magazine and the magazine joint and positioned toward the barrel, a magazine follower base that slides in the magazine, a pressing member that presses the magazine follower base toward the rear end of the toy gun, a trunk section that is pivotably mounted toward the rear end of the magazine follower base and allows a barrel side end thereof to slide in the magazine joint, and a magazine follower disposed on the barrel side end of the trunk section.

4 Claims, 15 Drawing Sheets

(56) References Cited

U.S. PATENT DOCUMENTS 2,569,995 A * 10/1951 Vojtech ..... F41A 9/62 116/298
2,631,578 A * 3/1953 Laughlin ..... F41B 7/006 124/27
2,881,752 A * 4/1959 Blahnik ..... F41B 11/51 124/36
3,142,294 A * 7/1964 Baldwin, Jr. ..... F41B 7/006 124/27
3,263,664 A * 8/1966 Bauer ..... F41A 9/83 124/49
3,996,916 A * 12/1976 Koehn ..... F41B 11/53 124/31
4,020,974 A * 5/1977 Bauer ..... B65D 83/0481 124/50
4,564,125 A * 1/1986 Esslinger ..... F42B 39/002 124/45
4,967,723 A * 11/1990 Cutrell ..... F42B 39/002 124/50
5,666,937 A * 9/1997 Mendoza-Orozco ..... F42B 6/10 124/51.1
5,755,055 A * 5/1998 Thompson ..... F41C 23/22 124/53
2006/0191523 A1* 8/2006 Paletz ..... F41B 11/51 124/67
2010/0043766 A1* 2/2010 Iwasawa ..... F41A 17/34 124/40
2013/0247890 A1* 9/2013 Gilley ..... F41A 9/83 124/51.1

* cited by examiner

TOY GUN

CROSS-REFERENCE TO RELATED APPLICATION(S)

This application is based upon and claims the benefit of priority from Japanese Patent Application JP2013-152915, filed on Jul. 23, 2013, the entire disclosure of which is incorporated herein by reference.

BACKGROUND ART

The present invention relates to a toy gun, and more specifically, to a toy gun's bullet feed mechanism that feeds BBs or other bullets to the toy gun.

A simplified bullet shooting mechanism for an air gun, which is called a barrel striker system, is already put to practical use (refer to U.S. Pat. No. 7,766,000 and U.S. Pat. No. 7,856,969). When a trigger is pulled during the use of the barrel striker system, a barrel first moves forward and then rapidly moves backward to strike a valve. This opens the valve to release gas, thereby allowing the gas to shoot a bullet.

When the barrel striker system is adopted particularly for a rifle air gun, which is a toy gun, the bullet feed mechanism needs to be carefully designed depending on the shape of the toy gun.

(1) For a handgun air gun, a magazine can be generally mounted either above the barrel or below the barrel. When the magazine is mounted below the barrel, the magazine is usually housed in a grip of the main body of the gun. One of the reasons is that the grip has an adequate space for housing the magazine, and that the magazine of a real gun is also housed in its grip. When the magazine is to be housed in the grip, a detachable cartridge magazine is often adopted. However, when a gun having a detachable magazine is used outdoors, there is a chance of losing the magazine. In addition, a relatively large number of parts are used for a gun having a detachable magazine. This increases not only the cost of manufacture but also the risk of failure.

As such being the case, a fixed magazine is sometimes disposed above and in parallel with the barrel for the purpose of reducing the number of parts and offering an inexpensive gun that is unlikely to become faulty.

(2) On the other hand, as for a rifle air gun, such as, for example, a toy gun that resembles an M24 sniper rifle or other real gun having an exposed barrel or a toy gun that resembles an M14 rifle or other real gun having a relatively small space between a barrel covering member and the barrel, there is extremely limited room for disposing the magazine above the barrel. As such being the case, the magazine is disposed below the barrel.

The rifle air gun has a longer barrel and is larger in size than the handgun air gun. Therefore, the space inside the gun, particularly the space below the barrel, is more than adequate except for a space in which a shooting mechanism is housed.

In view of the above circumstances, an inexpensive gun that steadily operates with the number of parts minimized to reduce not only the cost but also the risk of failure and permits the loading of many bullets to save the trouble of loading and provide increased convenience can be manufactured by disposing a bullet hopper below the main body of the toy gun (below the barrel) and disposing a fixed magazine below and in parallel with the barrel.

The following steps are performed to load bullets into the above-described toy gun:

a. Turn the toy gun upside down so that an opening in the hopper faces above.

b. Introduce the bullets into the opening in the hopper.

c. Hold the toy gun and shake it up and down several times until the bullets in the hopper drop into the magazine. After the bullets are loaded into the toy gun, restore the toy gun to its original orientation by turning it upside down again.

The next problem is how smoothly the bullets are fed into a chamber, which is a member disposed at the rearmost end of the barrel to retain the bullets. Although the magazine is positioned below the main body of the toy gun, the chamber is positioned above and behind the magazine. Hence, a spring-pressed magazine follower is disposed in the magazine and brought into contact with a bullet in the magazine to push the bullet upward toward the chamber. The bullet is then forwarded from the magazine, which is disposed in parallel with the barrel, toward the chamber through a tubular magazine joint that is bent and directed obliquely upward.

If the magazine follower is configured as a rod-shaped member, the magazine follower can move through the magazine, which is shaped like a straight tube, but cannot pass through the bent tubular magazine joint.

The bullet has to climb uphill toward the chamber against gravitational force although it is more or less spring-pressed. This may create a problem in which the bullet fails to reach the chamber, thereby causing a bullet feed failure.

Further, when the bullet is to be forwarded from a bullet feed storage and fed into the chamber through a bullet feed path, a route connecting the bullet feed storage to the chamber through the bullet feed path cannot always be formed in a linear manner from the viewpoint of the design of toy guns. In some cases, the route has to include an arc-like portion (curved portion). When, in particular, the distance between the chamber and the beginning of the arc-like portion is long, the shape of the follower needs to be carefully designed so that the magazine follower extrudes each remaining bullet.

In a toy gun described in Japanese Unexamined Patent Application Publication No. 2013-44460, a plurality of bullets B are introduced into a concave 48 with the toy gun G turned upside down and with the concave 48 facing upward in order to load the bullets B into a storage path 20 from a loading port 30 (see paragraph [0040]). Further, a joint 23 between a longitudinal portion 21 and an upright portion 22 is formed in a curved shape (see paragraph [0028]). As shown in FIG. 10, a follower 31 uses the pressing force of a push coil spring 32 to push the bullets B into a supply section 4 (see paragraph [0042]).

SUMMARY OF INVENTION

In the invention described in Japanese Unexamined Patent Application Publication No. 2013-44460, the bullets are fed into the chamber while the follower is pushed by the push coil spring. Further, a complicated mechanism is used so that a strand is threaded through the inside of the push coil spring and taken up by a take-up reel to retract the follower.

In the aforementioned invention, the employed mechanism is complicated due to the use of many parts although the magazine follower is set together, for example, with the push coil spring, the storage path, and a base member. In addition, the use of such a complicated mechanism may create a problem in which the spring fails to expand/contract in an arc-like path and fails to follow the bullets, thereby causing a bullet feed failure.

The present invention has been made in view of the above circumstances and provides a means of solving the aforementioned conventional problems by enabling a magazine follower main body to smoothly follow the bullets while using a low-cost, simple mechanism that uses a small number of parts and reduces the risk of failure.

A toy gun according to the present invention comprises:

a barrel in which bullets travel due to released gas;

a magazine that is cylindrically shaped and disposed in parallel with the barrel to house the bullets;

a magazine joint that couples the rear end of the magazine to the barrel and allows the bullets to travel therein;

a cut portion disposed between the magazine and the magazine joint;

a magazine follower base that slides in the magazine;

a pressing member that presses the magazine follower base toward the rear end of the toy gun;

a trunk section that is pivotably mounted toward the rear end of the magazine follower base, allows a barrel side end thereof to slide in the magazine joint, and is narrower than the cut portion; and a magazine follower disposed on the barrel side end of the trunk section.

In another embodiment, the toy gun wherein the cut portion is disposed toward the barrel and is narrower than the bullets and wherein the trunk section has a portion narrower than the cut portion is provided.

In another embodiment, the toy gun further comprises a hopper that holds the bullets and replenishes the magazine with the bullets.

The present invention differs from the invention described in Japanese Unexamined Patent Application Publication No. 2013-44460 in that the magazine follower has a simple mechanism formed of the magazine follower main body and a base section. Hence, cost reduction is achieved due to the use of a smaller number of parts. Further, the risk of failure is reduced. In addition, the present invention performs a stable operation as the magazine follower main body smoothly follows the bullets.

DESCRIPTION OF EMBODIMENTS

An embodiment of the present invention will now be described with reference to the accompanying drawings illustrating the embodiment.

Figure 1:
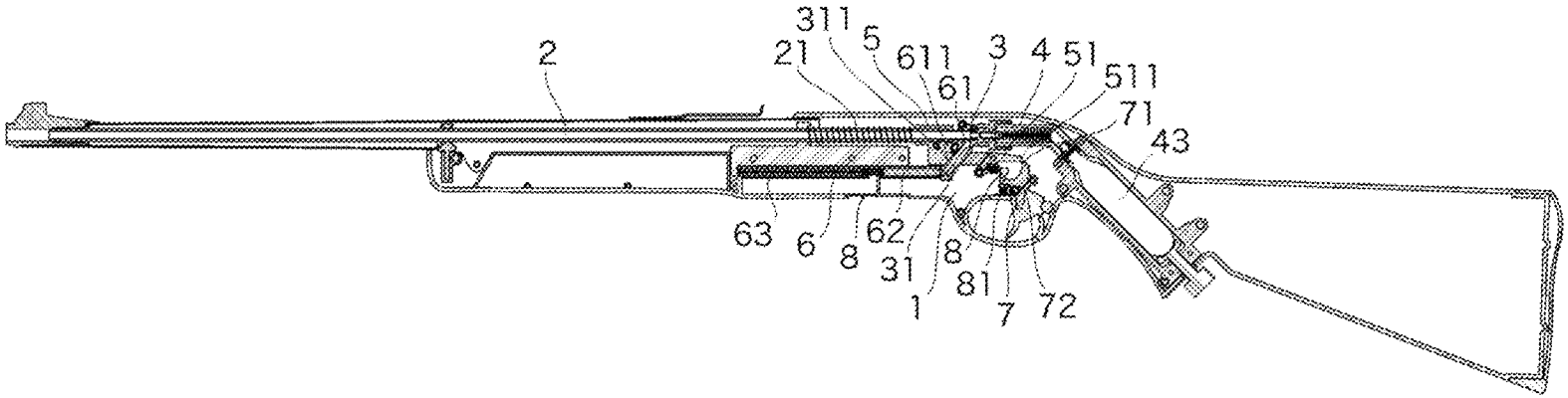
FIG. 1 is a front cross-sectional view of a barrel striker type rifle air gun, which is a toy gun according to an embodiment of the present invention.
Figure 2:
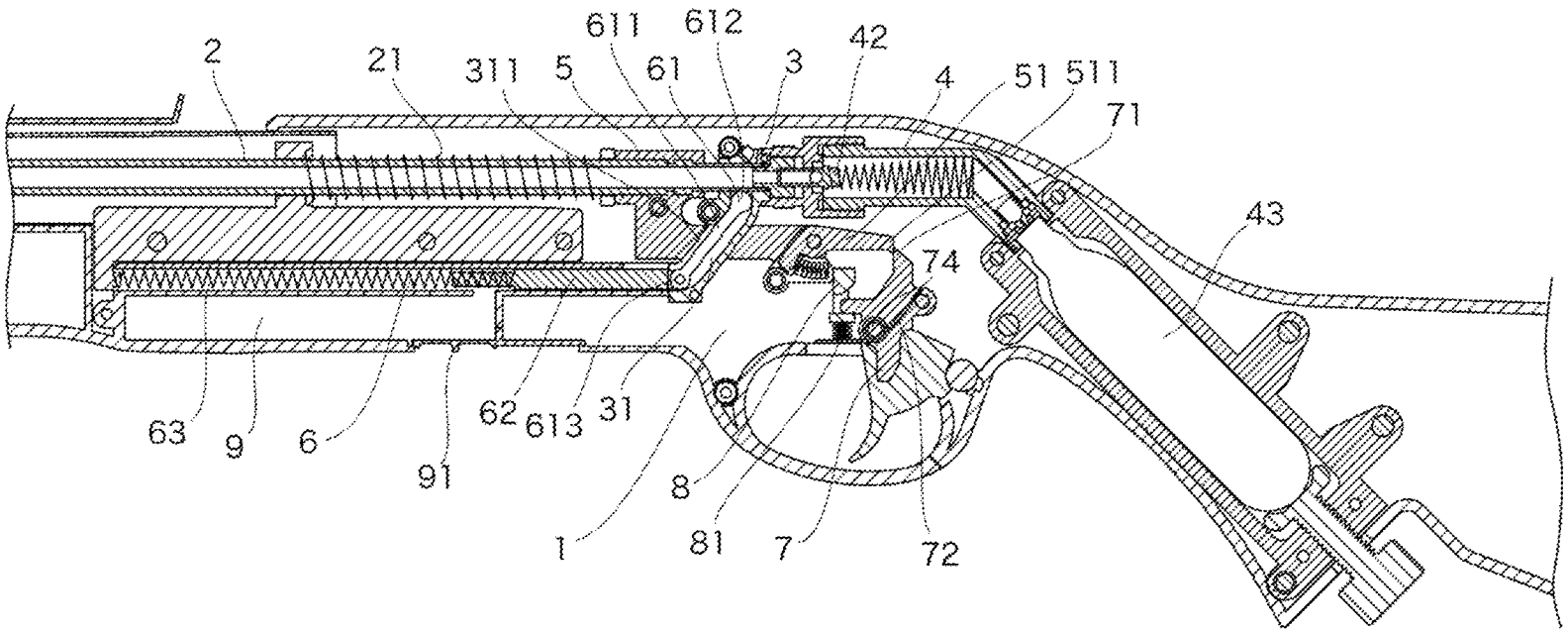
FIG. 2 is an enlarged view illustrating an initial state of an engine of the barrel striker type rifle air gun, which is the toy gun according to the embodiment of the present invention.

FIG. 1 is a front cross-sectional view of a barrel striker type rifle air gun, which is a toy gun according to an embodiment of the present invention. FIG. 2 is an enlarged view illustrating an initial state of an engine of the barrel striker type rifle air gun.

A barrel striker system employed by the toy gun according to the embodiment of the present invention will now be described.

(1) In the barrel striker system, a trigger 7 presses a sear 51 to move it forward. The sear 51 is a movable engaging member provided for a barrel 2. When the barrel 2 moves forward to disengage the sear 51 from the trigger 7, the force of a barrel spring 21 causes the barrel 2 to rush backward, thereby striking a release valve 42. Compressed gas released from a cylinder 43 then shoots a bullet B.

(2) When a handgun air gun, which is a toy gun, adopts the barrel striker system, the length of the top of the trigger 7 is often increased to a certain extent to dispose a small, box-shaped sear base 5 on the barrel 2 and pivotably mount the sear 51 on the sear base 5. The handgun air gun is a relatively small toy gun and requires the use of a small shooting mechanism. The distance between a finger hook of the trigger 7 and a front-rear movable axis of the barrel 2 (a front-rear straight line serving as the central axis of the barrel 2) is as short as 1 or 2 centimeters. Therefore, the sear 51 may be positioned on the front-rear movable axis of the barrel 2 in the same manner as used by a conventional technology.

(3) Meanwhile, a rifle air gun, which is also a toy gun, is often larger in the size of an engine than the handgun air gun. The distance between the trigger 7 and the barrel 2 of the rifle air gun is generally long. Therefore, when the sear 51 is disposed on the front-rear movable axis of the barrel 2, it is necessary that the top of the trigger 7 be extremely long.

If the top of the trigger 7 is extremely long, great force is applied to the sear 51 from the viewpoint of moment of inertia and from the principle of leverage simply when the trigger 7 is slightly pulled. In other words, the barrel 2 moves forward over an increased distance.

However, from the viewpoint of safety, the trigger 7 of a toy gun usually has a pulling allowance (play). No matter whether a safety device is incorporated, a problem of safety arises if a slight pull on the trigger 7 causes the barrel 2 to move forward and readily shoot a bullet. As such being the case, the distance between a trigger axis 74 and the leading end of the trigger 7 needs to be shortened in order to assure an appropriate trigger pull (the force exerted when the trigger 7 presses the barrel 2).

As indicated above, when the barrel striker system is to be adopted as a shooting mechanism for the above-described toy gun, appropriate measures need to be taken to optimize the trigger pull. The trigger pull is determined, for instance, by the shape of the trigger 7, the shape of the sear 51, the distance (trigger stroke length) over which the trigger 7 can press the sear 51, and the distance (barrel stroke length) over which the barrel 2 moves forward and backward. Therefore, appropriate measures need to be taken to properly adjust the above-mentioned shapes and distances.

(4) In view of the above circumstances, the embodiment of the present invention is configured so that the sear base 5 is disposed below the front-rear movable axis of the barrel 2 to position the sear 51 in the vicinity of the trigger 7. The sear base 5 is extended downward from its joint with the barrel 2, bent perpendicularly toward the rear end of the toy gun, and further extended in parallel with the barrel 2, a chamber 3, and a valve body. The sear 51 is disposed at the rearmost end of the sear base 5. When pulled, the trigger 7 engages with the sear 51 to press the sear base 5, thereby moving the barrel 2 forward.

The above ensures that the trigger pull, the trigger stroke length, and the barrel stroke length can be properly adjusted. Consequently, the barrel striker system can be adopted for the rifle air gun.

Referring to FIG. 2, the reference numeral 1 denotes a frame of the toy gun. A muzzle of the toy gun is positioned on the left side of FIG. 2. The rear end of the toy gun is positioned on the right side of the same figure. The reference numeral 2 denotes the barrel.

When the gas is released from the cylinder 43, a bullet B travels in the barrel 2. The barrel spring 21 is disposed behind the barrel 2 to press the barrel 2 toward the rear end of the toy gun.

The reference numeral 3 denotes the chamber. The reference numeral 4 denotes the valve body.

Figure 12:
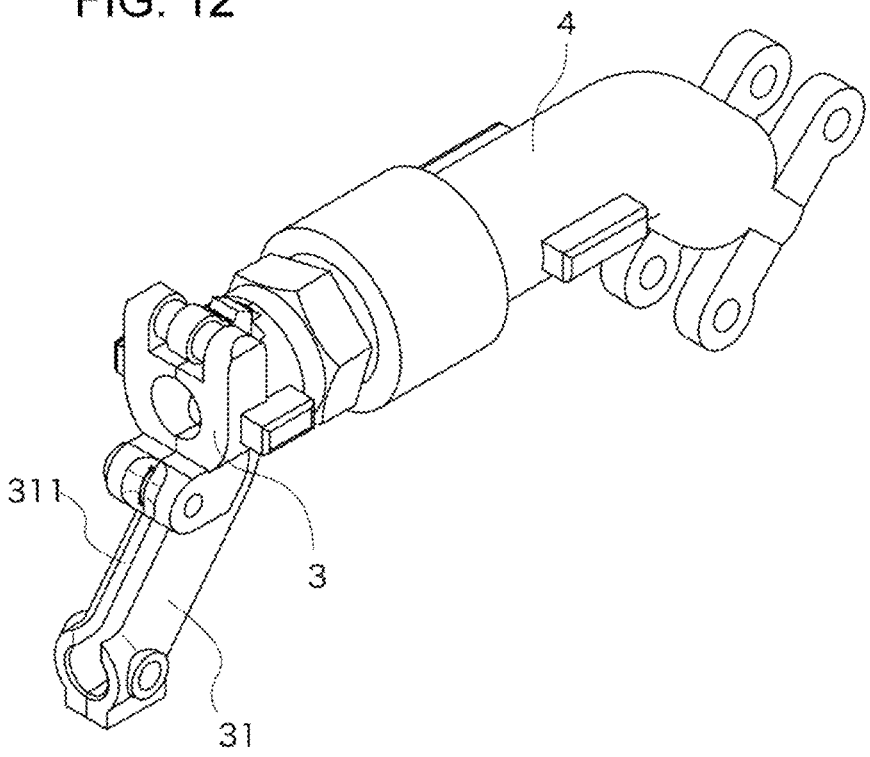
FIG. 12 is a perspective view of parts of the toy gun according to the embodiment of the present invention.
Figure 13:
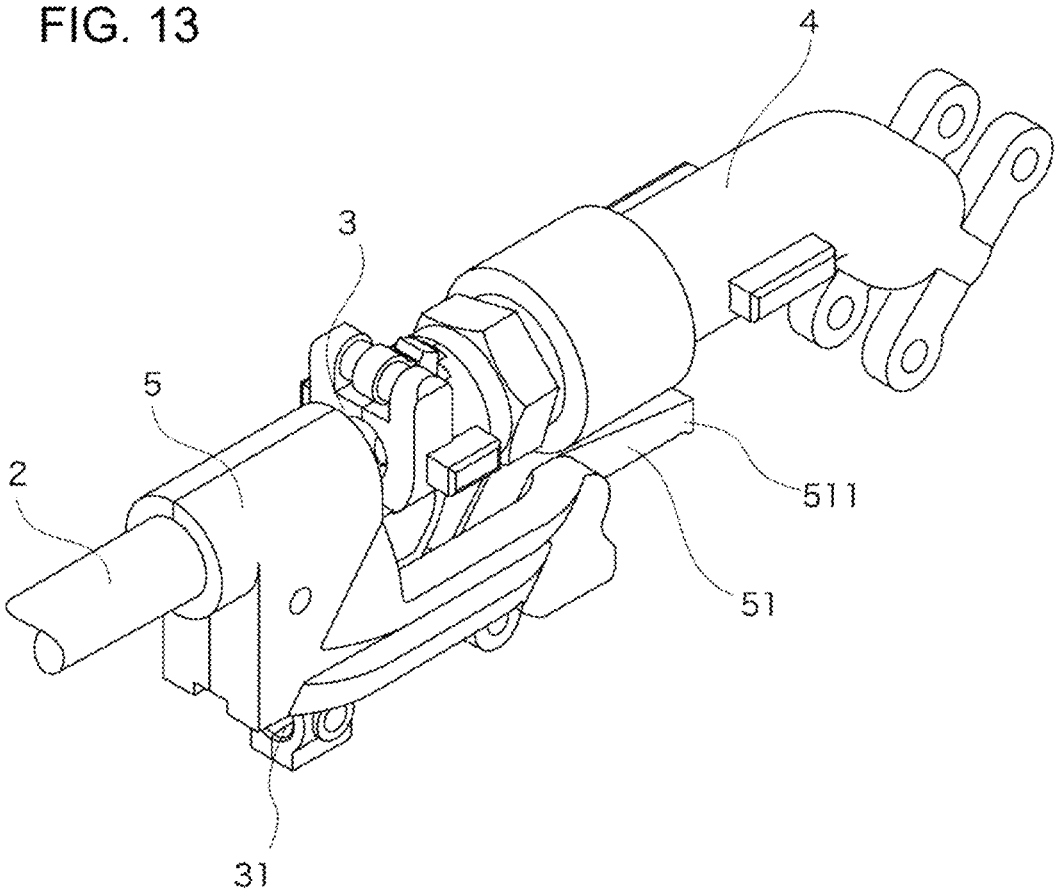
FIG. 13 is a perspective view of parts of the toy gun according to the embodiment of the present invention.

The chamber 3 is disposed between the barrel 2 and the valve body 4. The chamber 3 is shaped as shown in FIGS. 12 and 13 and disposed so that the rear end of the barrel 2 can be inserted into the chamber 3. When a bullet B is fed, it remains in the chamber 3 until it is shot. While the barrel 2 is moving forward with the trigger 7 pulled, a bullet B in the chamber 3 is in contact with the next bullet. However, the bullet B in the chamber 3 is captured and introduced into the barrel 2 immediately before the barrel 2 is fully retracted. Thus, the bullet B in the chamber 3 is brought out of contact with the next bullet.

The reference numeral 5 denotes the sear base. As shown in FIG. 2 and later, the sear base 5 is secured to the rear end of the barrel 2. As shown in FIG. 13, the embodiment is configured so that the barrel 2 is laterally sandwiched between two members of the sear base 5. However, an alternative is to fit the sear base 5 into its position from one side by using one member and mount the sear 51 on its rear end.

As shown in FIGS. 2 and 13, the sear base 5 is extended vertically downward from the joint with the barrel 2, bent perpendicularly toward the rear end of the toy gun, and further extended in parallel with the front-rear movable axis of the barrel 2. Further, the pivotable sear 51 is disposed at the rearmost end of the sear base 5. The sear 51, which is mounted on the sear base 5 that is bent and extended in parallel with the barrel 2, is positioned 8 mm or more away from the front-rear movable axis of the barrel 2. When pulled, the trigger 7 engages with the sear 51 to press the sear base 5, thereby moving the barrel 2 forward.

When the barrel 2 moves, the sear 51 also moves. More specifically, the sear 51 moves along an axis that is positioned in parallel with and 8 mm or more below the front-rear movable axis of the barrel 2.

The sear 51 directly engages with the trigger 7.

The reference numeral 6 is the magazine. The magazine 6 is cylindrically shaped to house bullets B and disposed in parallel with the barrel 2. A magazine follower 61, which includes a magazine follower main body (trunk section) 611 and a magazine follower base 62, is provided to feed the bullets B in the magazine 6 to the chamber 3.

More specifically, the magazine follower 61 includes the trunk section 611, which is the magazine follower main body, a bullet contact section 612, and a joint section 613. The trunk section 611 is a rod-like member and smaller in diameter than the bullets B. The trunk section 611 has a portion having a narrower width than a cut in a cut portion 311 and is able to move out of the cut portion 311.

The bullet contact section 612 and the joint section 613 are disposed on either end of the trunk section 611. The inside diameter of the bullet contact section 612 is substantially the same as the diameter of the bullets B. In other words, the bullet contact section 612 is larger in diameter than the trunk section 611. The magazine follower base 62 is formed of a member that is substantially cross-shaped as shown in FIG. 14.

Figure 14:
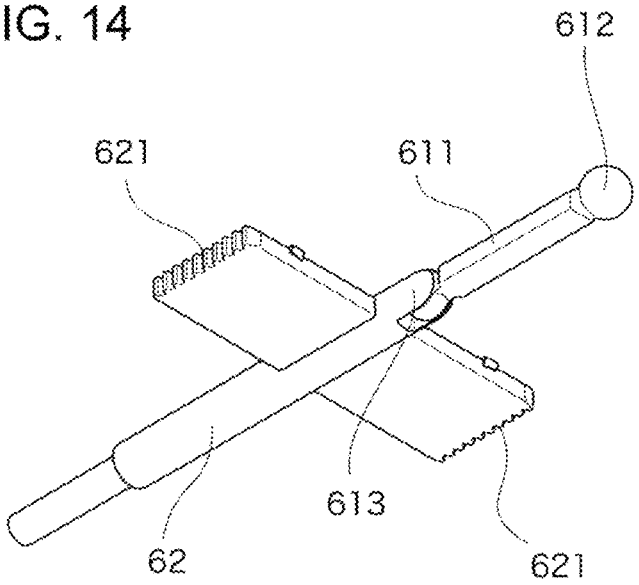
FIG. 14 is a perspective view of parts of the toy gun according to the embodiment of the present invention.
Figure 15:
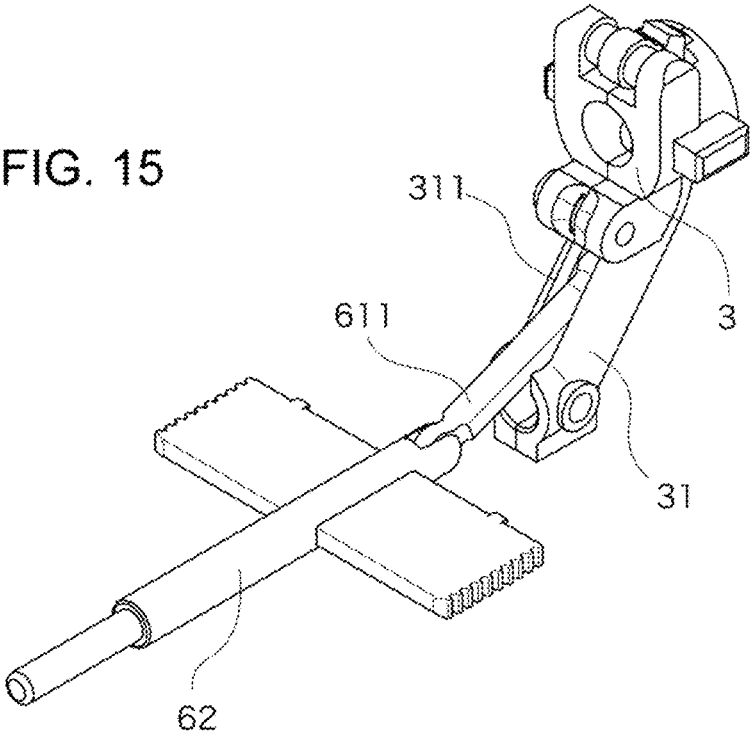
FIG. 15 is a perspective view of parts of the toy gun according to the embodiment of the present invention.

As shown in FIGS. 14 and 15, a knob 621 protrudes in a wing-like fashion in the width direction of the toy gun from a lateral surface of the magazine follower base 62.

Figure 3:
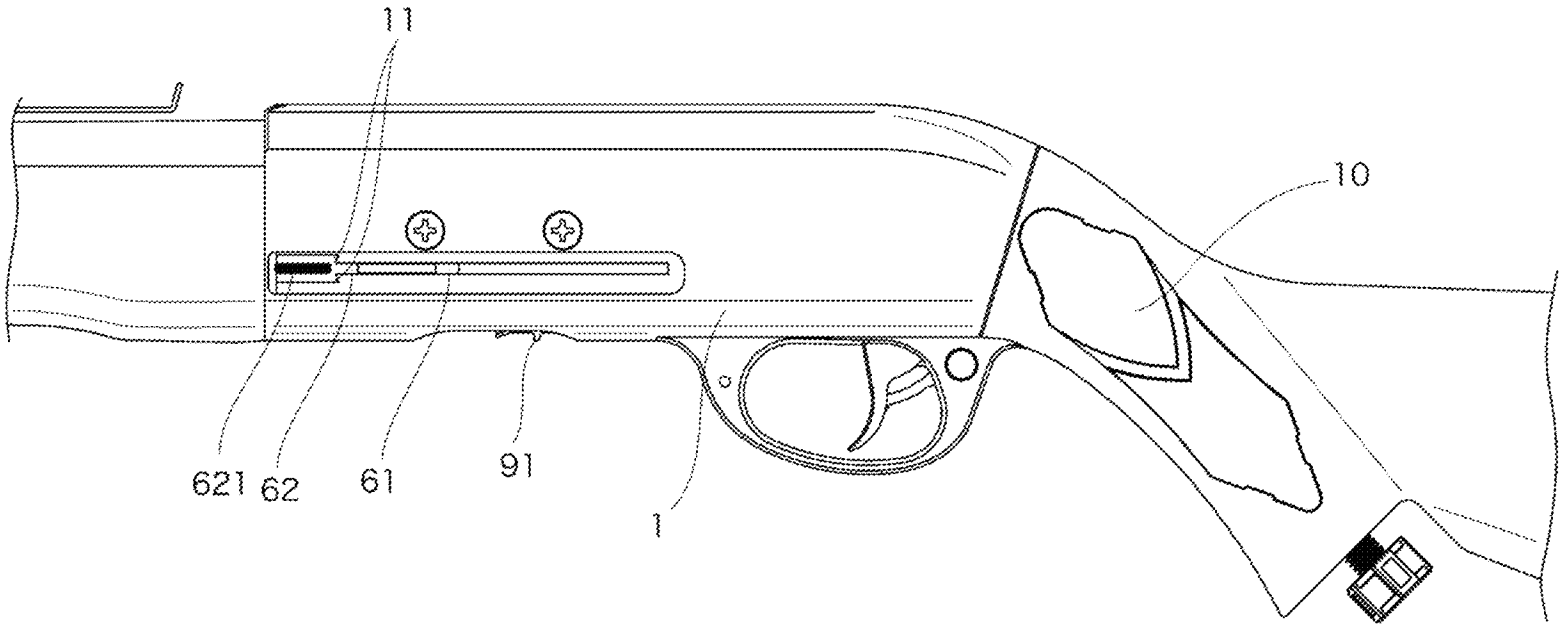
FIG. 3 is an enlarged side view of the engine of the toy gun according to the embodiment of the present invention that is shown in FIG. 2.
Figure 4:
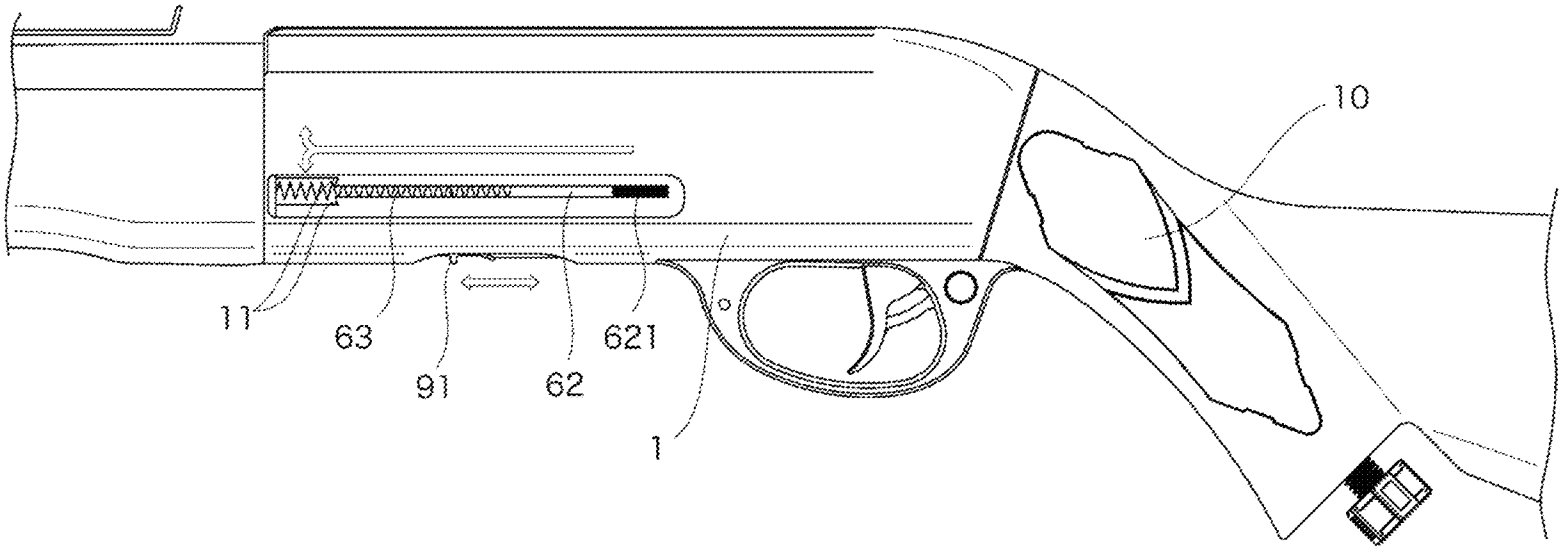
FIG. 4 shows a state in which a knob in the state shown in FIG. 3 is moved toward the rear end of the toy gun according to the embodiment of the present invention.
Figure 5:
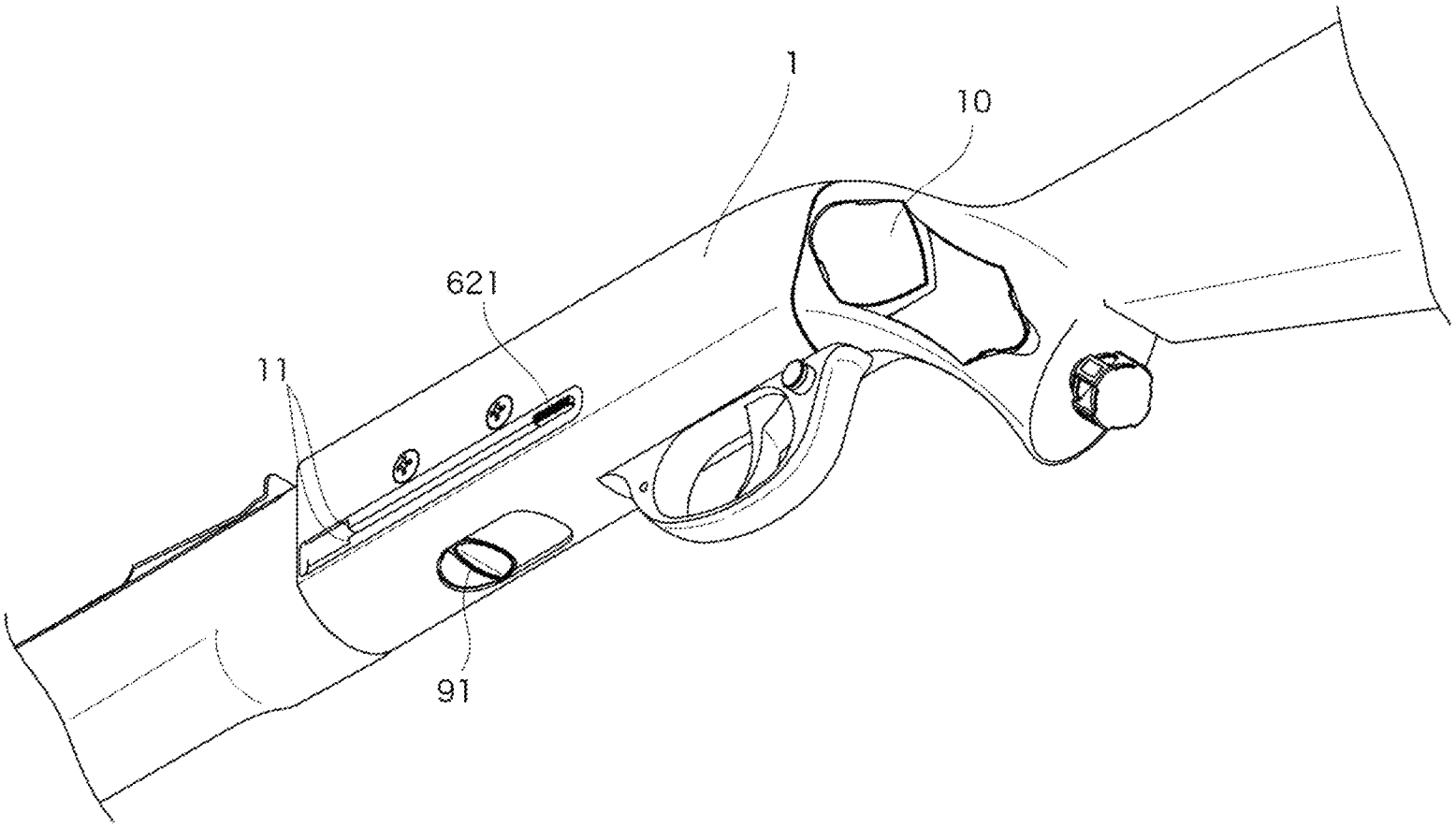
FIG. 5 shows the engine of the toy gun according to the embodiment of the present invention when viewed from below.

As shown in FIGS. 3 to 5, the magazine follower base 62 can be repositioned by holding the knob 621 from the outside of the toy gun and moving it.

The magazine follower 61 is positioned in the magazine 6 or cartridge magazine 6 and hinged to the magazine follower base 62.

The reference numeral 31 denotes a magazine joint. The magazine joint 31 is tubularly shaped and disposed between the magazine 6 or cartridge magazine 6 and the chamber 3. The magazine joint 31 couples the rear end of the magazine 6 to the barrel 2. The bullets B travel in the magazine joint 31.

The magazine joint 31 is a tubular member having a cross section shaped like the letter C. The magazine joint 31 has the cut portion 311, which is provided to fit to the magazine follower main body 611. The cut portion 311, which has a narrower width than the bullets, is disposed longitudinally with its cut positioned toward the barrel 2.

The magazine joint 31 has the cut portion 311. More specifically, the cut portion 311 is disposed between the magazine 6 and the magazine joint 31 and positioned toward the barrel 2.

The leading end of the magazine follower 61, which is a barrel side end of the magazine follower 61, slides in the magazine joint 31. When an arm section of the magazine follower 61 reaches the cut portion 311, the arm section protrudes from the cut portion 311 toward the barrel 2.

The trunk section 611 of the magazine follower main body 611 protrudes from the cut portion 311. The cut portion 311 is wider than the central portion of the trunk section 611, but is narrower than the bullet contact section 612. Therefore, the bullet contact section 612 does not protrude from the cut portion 311, but stays within the magazine joint 31.

The reference numeral 61 denotes the magazine follower. The magazine follower 61 is disposed on an end of the magazine follower main body (trunk section) 611 that is positioned toward the barrel 2.

The reference numeral 62 denotes the magazine follower base. The magazine follower base 62 slides in the magazine 6.

The reference numeral 63 is a magazine follower spring that acts a pressing member. The pressing member (magazine follower spring) 63 presses the magazine follower base 62 toward the rear end of the toy gun.

The magazine follower main body (trunk section) 611 is pivotably hinged to the rear end of the magazine follower base 62. More specifically, the magazine follower main body 611 is hinged so that it can pivot toward the barrel 2.

In the present embodiment, two members, namely, the magazine follower main body (trunk section) 611 and the magazine follower base 62 are coupled together to form the magazine follower 61. The magazine follower main body 611 and the magazine follower base 62 are joined together through the joint section 613, which is a coupling shaft, to form a hinge-shaped member.

One end of the magazine follower main body 611 is in contact with a bullet B in the bullet contact section 612. The other end is coupled to one end of the magazine follower base 62 through the joint section 613, which is a coupling shaft.

Both ends of the magazine follower main body 611 have an inside diameter that is substantially the same as the diameter of the bullets B. A portion other than both ends of the magazine follower main body 611 is the arm section having an inside diameter slightly smaller than the diameter of the bullets B.

The magazine follower spring 63, which is formed of a spring or other elastic body, is fitted into or otherwise attached to the other end of the magazine follower base 62. Further, the upper part of the tubular magazine joint 31 is cut to form the cut portion 311.

The cut in the cut portion 311 of the magazine joint 31 is proportional to the size of the bullets B. In the present embodiment, the width of the cut is not greater than 75% of the diameter of the bullets B.

When, for instance, 4.5 mm BBs are used, the width of the cut is not greater than 4.5×0.75=3.375 mm. When 6 mm BBs are used, the width of the cut is not greater than 6×0.75=4.5 mm.

When the arm section of the magazine follower main body 611 passes through the cut portion 311, the arm section protrudes outward, that is, toward the barrel 2. This enables the bullet contact section of the magazine follower main body to push the bullets B and smoothly travel not only in the magazine 6 but also in a path between the magazine joint 31 and the vicinity of the chamber 3.

Even when a detachable cartridge magazine 6 is inserted into the toy gun from below in order to feed the bullets, the same operational advantage can be obtained as far as the above-described structure is employed for the path between the cartridge magazine 6 and the chamber 3 through which the bullets B travel.

The sear base 5 is disposed so that it passes along a lateral surface of the magazine joint 31. If the sear base 5 is designed so that the magazine joint 31 is tucked into the sear base 5, the sear base 5 is disposed to surround the magazine joint 31. In any case, the magazine joint 31 and the sear base 5 do not interfere or collide with each other.

The reference numeral 9 denotes a hopper.

The hopper 9 is disposed below the magazine 6 and capable of acting as a temporary storage for the bullets B. The hopper 9 holds the bullets B and replenishes the magazine 6 with the bullets B. The hopper 9 is provided with a bottom cover 91.

The cartridge magazine 6 may be disposed in place of the magazine 6.

The following description is given with reference to FIG. 2, which illustrates the initial state of an operation of the toy gun.

The trigger 7 is disposed so that it pivots around the trigger axis 74. The trigger 7 is pushed in a clockwise direction, as viewed in FIG. 2, by a trigger spring 72. A sear press section 71 is disposed above the trigger 7. In the initial state, the sear press section 71 of the trigger 7 is in contact with the sear 51 at a sear end 511, which is disposed toward the rear end of the sear 51.

An inner safety 8 is positioned in contact with the sear base 5 in the initial state. When the toy gun is tilted to orient the muzzle upward, the barrel 2 tends to fall under its own weight. However, the inner safety 8 comes into contact with the sear base 5 to stop the barrel 2. Thus, the barrel 2 does not strike the valve, and shooting of a bullet B does not happen. This prevents an accidental discharge of a bullet B.

FIG. 3 will now be described. FIG. 3 is an enlarged side view of the engine of the toy gun according to the embodiment of the present invention.

The magazine follower base 62 is configured so that the bullets B in the hopper 9 drop into the magazine 6 for loading purposes when the toy gun is turned upside down with the knob 621 moved toward the muzzle. FIG. 3 shows a state in which the knob 621 is moved toward the muzzle.

FIG. 4 shows a state in which the knob 621 in the state shown in FIG. 3 is moved toward the rear end of the toy gun. More specifically, FIG. 4 shows a state in which the magazine follower base 62 is thoroughly moved toward the rear end of the toy gun, that is, the bullets B need to be loaded.

FIG. 5 shows the engine of the toy gun according to the embodiment of the present invention when viewed from below.

Figure 6:
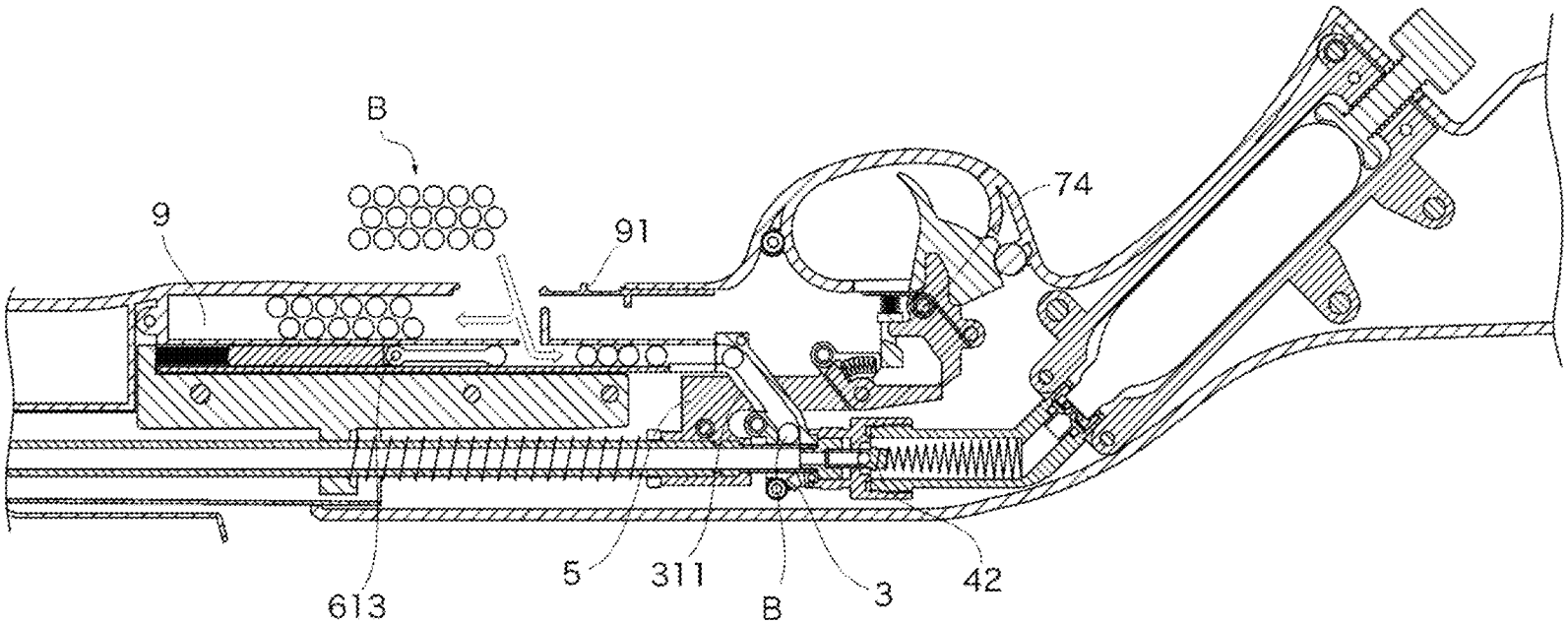
FIG. 6 shows a state in which bullets are being loaded into the toy gun according to the embodiment of the present invention that is turned upside down.

FIG. 6 shows a state in which the bullets B are being loaded with the toy gun turned upside down.

The bottom cover 91 of the hopper 9 is opened to introduce the bullets B. The bullets B flow into the magazine 6 through a magazine connection port in the hopper 9. Some of the bullets B further flow into the magazine joint 31. Although the magazine joint 31 has the cut portion 311, the cut is narrower than the diameter of the bullets B. Therefore, the bullets B do not flow out of the magazine joint 31.

Figure 7:
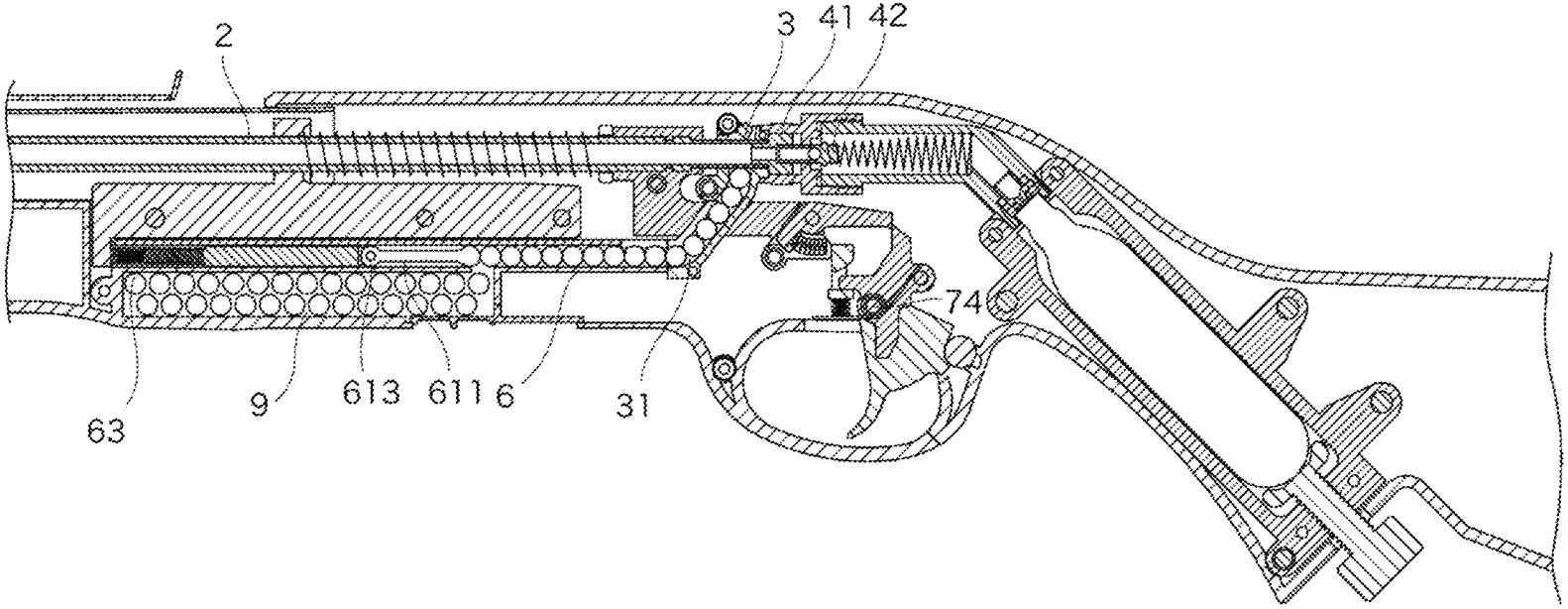
FIG. 7 is a side cross-sectional view of the toy gun according to the embodiment of the present invention that is restored from the inverted orientation shown in FIG. 6 to its original orientation by turning it upside down again.

FIG. 7 is a side cross-sectional view of the toy gun that is restored from the inverted orientation to its original orientation.

The bullets B introduced from the hopper 9 into the magazine 6 and forwarded into the magazine joint 31 are pressed by the magazine follower spring 63 until they are loaded to a place in front of the chamber 3. As the top of the magazine joint 31 is covered by the rear end of the barrel 2, the bullets B cannot move upward and cannot enter the chamber 3.

Figure 8:
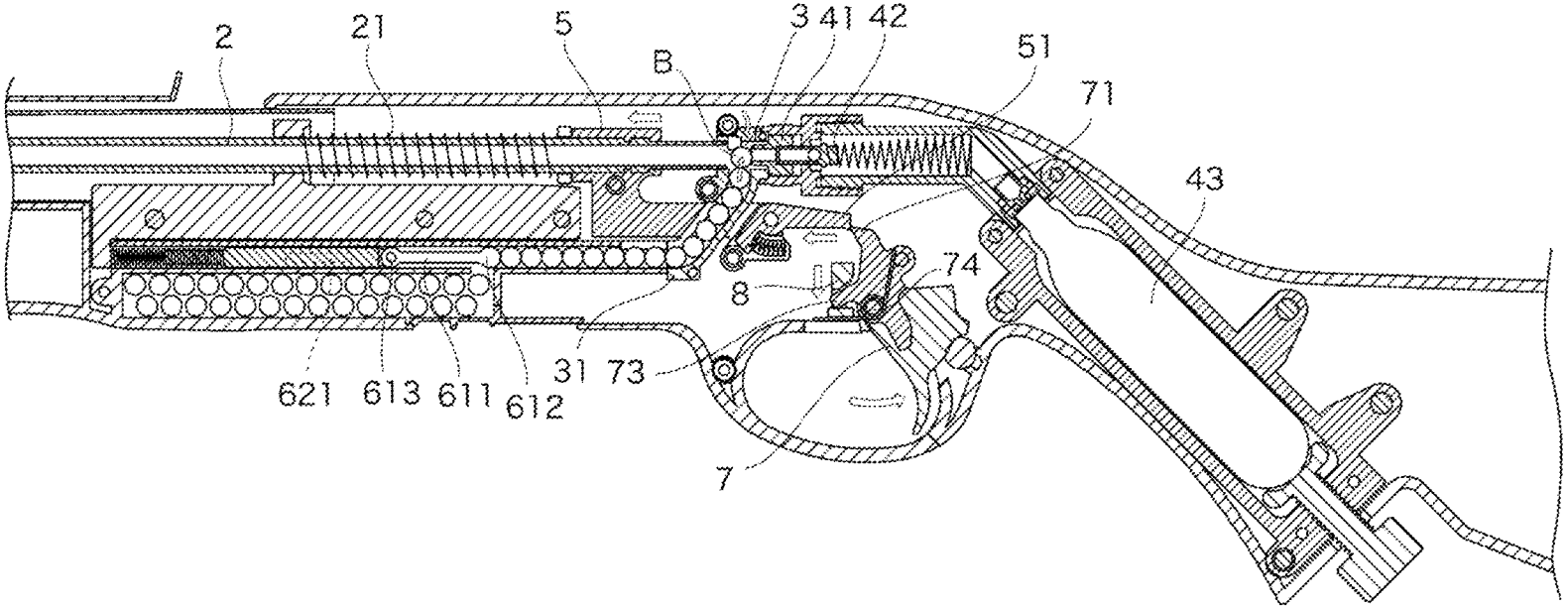
FIG. 8 is a side cross-sectional view of the toy gun according to the embodiment of the present invention that is obtained at the moment its trigger is pulled.

FIG. 8 is a side cross-sectional view that is obtained at the moment the trigger 7 is pulled.

(1) When the trigger 7 is pulled, an inner safety engaging section 73 of the trigger 7 pivots to press the inner safety 8 downward, thereby causing the sear press section 71 of the trigger 7 to press the sear 51 toward the muzzle.

(2) As the sear 51 is pressed, the sear base 5 and the barrel 2 move forward against the pressure created by the pressing member 21. The uppermost bullet B among the bullets B in the magazine joint 31, which are blocked from moving upward by the barrel 2, then enters the chamber 3.

Figure 9:
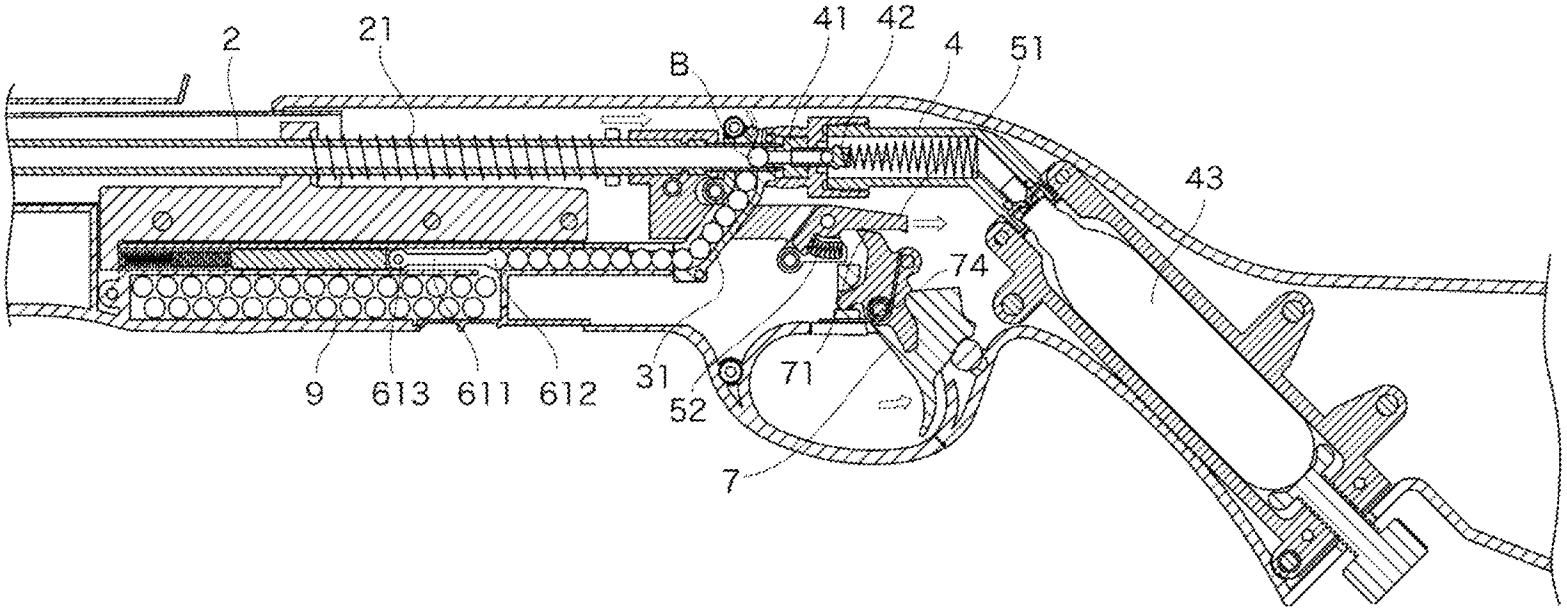
FIG. 9 is a side cross-sectional view of the toy gun according to the embodiment of the present invention that is obtained at the moment its barrel strikes a hit pin.

FIG. 9 is a side cross-sectional view of the toy gun that is obtained at the moment the barrel 2 strikes a hit pin. (1) When the trigger 7 continuously presses the sear 51, the barrel 2 moves forward. Before long, the sear 51 separates from the trigger 7. However, the barrel 2 itself continuously moves forward due to inertia and then comes to a stop. Subsequently, the barrel 2 suddenly begins to move backward due to the pressing force of the pressing member 21. The barrel 2 then strikes the hit pin 41 in the valve body 4 and stops moving backward.

(2) A sear spring 52 causes the sear 51 to pivot counterclockwise and then stop. In the resulting state, the sear 51 continuously moves backward. The sear 51 comes to a stop when it is positioned above the sear press section 71 of the trigger 7.

(3) As the hit pin 41 is stricken, the hit pin 41 moves backward and comes into contact with the release valve 42, thereby moving the release valve 42 backward. The valve body 4 is then rendered nonairtight.

Figure 10:
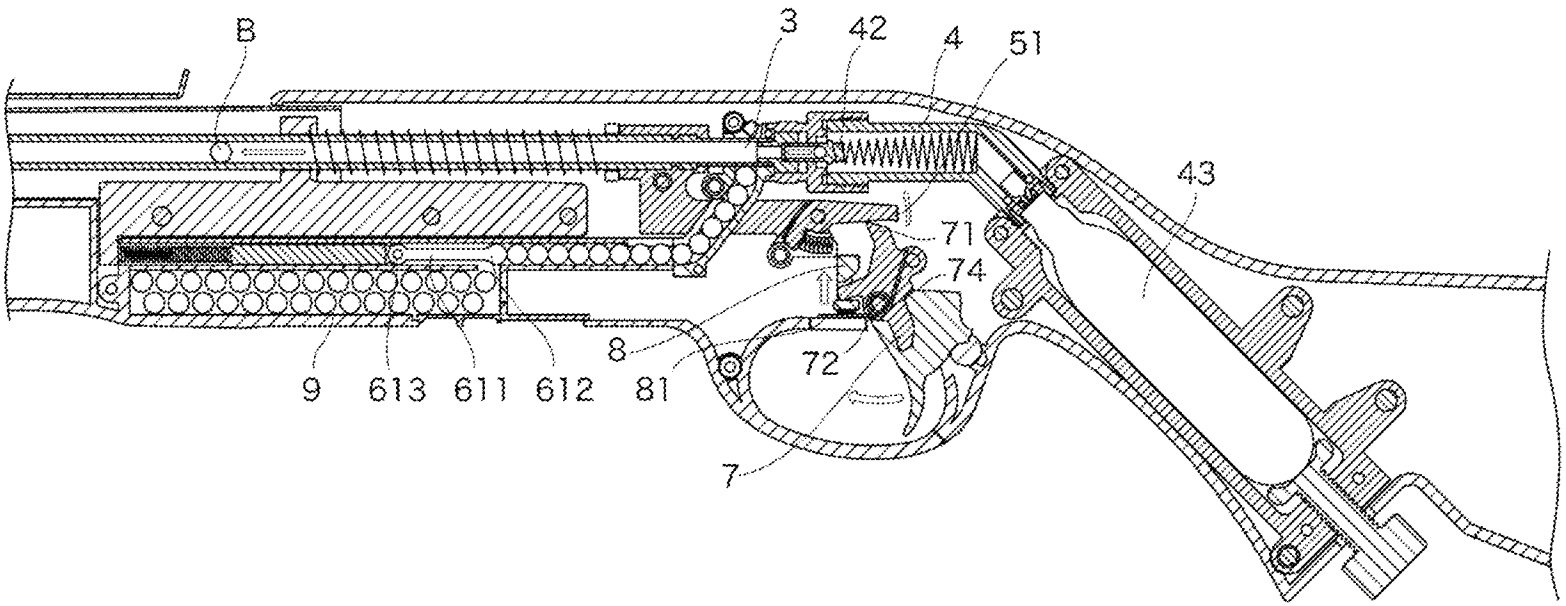
FIG. 10 is a side cross-sectional view of the toy gun according to the embodiment of the present invention that is obtained immediately before its bullet is shot.

FIG. 10 is a side cross-sectional view of the toy gun that is obtained immediately before its bullet B is shot.

(1) When the release valve 42 moves backward to render the valve body 4 nonairtight, the gas introduced into the valve body 4 from the cylinder 43 drastically flows into the chamber 3 from a gap between the valve body 4 and the release valve 42. As a result, a bullet B in the chamber 3 is pushed forward by the pressure of the gas and shot.

(2) When a shooter's finger is released from the trigger 7, the trigger 7 pivots clockwise and returns to its previous position due to the pressing force of the trigger spring 72. The sear 51 is then pushed upward by the sear press section 71 of the trigger 7 and returned to its previous position. Further, the inner safety 8 moves upward due to the pressing force of an inner safety spring 81 and returns to its previous position.

Figure 11:
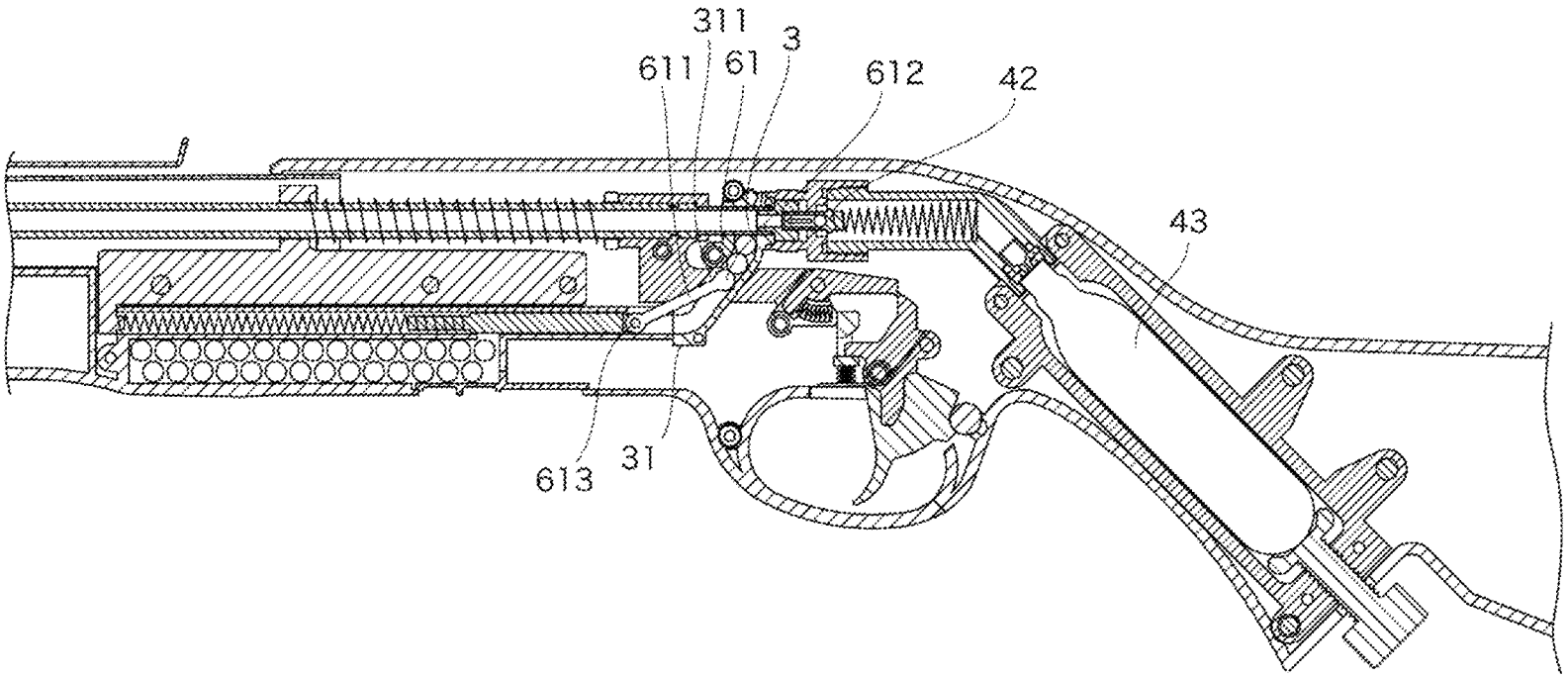
FIG. 11 is a side cross-sectional view of the toy gun according to the embodiment of the present invention that is obtained when there are a small number of bullets in a magazine joint.

FIG. 11 is a side cross-sectional view of the toy gun that is obtained when there are a small number of bullets B in the magazine joint 31.

In the state shown in FIG. 11, the magazine follower 61 operates so that the bullet contact section 612 pushes up the bullets B in order to move them upward while the trunk section 611 of the magazine follower 61 is protruding from the cut portion 311 of the magazine joint 31. This causes each remaining bullet B to be introduced into the chamber 3 without being jammed.

FIGS. 12 to 15 are enlarged perspective views of parts of the toy gun.

FIG. 12 is a perspective view of the valve body 4, the chamber 3, and some other parts. FIG. 13 is a perspective view of the barrel 2, the sear base 5, and the sear 51 in addition to the parts shown in FIG. 12.

FIGS. 14 and 15 are perspective views of the magazine follower 61 and the magazine follower base 62.

REFERENCE NUMERALS

2 Barrel
21 Pressing member
6 Magazine
61 Magazine follower
611 Magazine follower main body
62 Magazine follower base
63 Pressing member (magazine follower spring)
31 Magazine joint
311 Cut portion
B Bullet

What is claimed is:

1. A toy gun comprising:
a barrel in which bullets travel due to released gas;
a magazine that is cylindrically shaped and disposed in parallel with the barrel to house the bullets;
a magazine joint that couples the rear end of the magazine to the barrel and allows the bullets to travel therein;
a cut portion disposed on the magazine joint;
a magazine follower base that slides in the magazine;
a pressing member that presses the magazine follower base toward the rear end of the toy gun;
a trunk section that is pivotably mounted toward the rear end of the magazine follower base, allows a barrel side end thereof to slide in the magazine joint, and is narrower than the cut portion; and
a magazine follower disposed on the barrel side end of the trunk section, wherein,
the arm section of the magazine follower protrudes from the cut portion when the leading end of the magazine follower slides in the magazine joint.

2. The toy gun according to claim 1, wherein the cut portion is disposed toward the barrel and is narrower than the bullets; and wherein the trunk section has a portion narrower than the cut portion.

3. The toy gun according to claim 1, further comprising:
a hopper that holds the bullets and replenishes the magazine with the bullets and is disposed in the toy gun.

4. The toy gun according to claim 2, further comprising:
a hopper that holds the bullets and replenishes the magazine with the bullets and is disposed in the toy gun.

* * * * *